US009187839B2

(12) United States Patent
Sheehy

(10) Patent No.: US 9,187,839 B2
(45) Date of Patent: Nov. 17, 2015

(54) PROCESS FOR THE MANUFACTURE OF SEALED ANODIZED ALUMINUM COMPONENTS

(76) Inventor: Michael Sheehy, Grand Rapids, MI (US)

( * ) Notice: Subject to any disclaimer, the term of this patent is extended or adjusted under 35 U.S.C. 154(b) by 413 days.

(21) Appl. No.: 13/249,340

(22) Filed: Sep. 30, 2011

(65) Prior Publication Data

US 2012/0088033 A1 Apr. 12, 2012

Related U.S. Application Data

(60) Provisional application No. 61/390,695, filed on Oct. 7, 2010.

(51) Int. Cl.

| | |
|---|---|
| ***C25D 11/18*** | (2006.01) |
| ***C25D 11/24*** | (2006.01) |
| ***C25D 11/04*** | (2006.01) |
| ***B05D 5/00*** | (2006.01) |
| ***B05D 1/36*** | (2006.01) |
| ***B05D 3/10*** | (2006.01) |
| ***B05D 7/14*** | (2006.01) |

(52) U.S. Cl.

CPC *C25D 11/04* (2013.01); *B05D 1/36* (2013.01); *B05D 3/102* (2013.01); *B05D 3/107* (2013.01); *B05D 5/00* (2013.01); *B05D 7/14* (2013.01); *C25D 11/045* (2013.01); *C25D 11/24* (2013.01); *C25D 11/243* (2013.01)

(58) Field of Classification Search

None

See application file for complete search history.

(56) References Cited

U.S. PATENT DOCUMENTS

| | | | |
|---|---|---|---|
| 2,126,954 A | 8/1938 | Edwards | |
| 3,374,155 A | 3/1968 | Weber | |
| 3,616,298 A | 10/1971 | Fassell, Jr. | |
| 4,045,599 A | 8/1977 | Remaley et al. | |
| 4,521,463 A | 6/1985 | Powers et al. | |
| 4,877,495 A | 10/1989 | Buchmeier et al. | |
| 6,447,665 B1 | 9/2002 | Johnson et al. | |
| 6,797,014 B1 | 9/2004 | Schofberger et al. | |
| 7,029,597 B2 | 4/2006 | Marczak et al. | |
| 2005/0218004 A1 * | 10/2005 | Charles | 205/196 |
| 2006/0191599 A1 | 8/2006 | Matzdorf et al. | |

FOREIGN PATENT DOCUMENTS

JP 2006312754 11/2006

OTHER PUBLICATIONS

Diggle et al., "Anodic oxide films on aluminum," Chem. Rev., 1969, 69 (3), 365-405.*

Kalantary et al., "A model for the mechanism of nickel fluoride cold sealing of anodized aluminum," Journal of Applied Electrochemistry 22 (1992) 268-276.*

Hao et al., "Sealing Process of Anodic Coatings—Past, Present, and Future," Metal Finishing, Dec. 2008, pp. 8-18.*

International Search Report and Written Opinion, Apr. 17, 2012, from International Application No. PCT/US2011/055098.

* cited by examiner

*Primary Examiner* — William Phillip Fletcher, III

(74) *Attorney, Agent, or Firm* — Price Heneveld LLP

(57) ABSTRACT

A more efficient process of sealing an anodized aluminum article, which can facilitate higher production rates than conventional sealing techniques, includes steps of providing an article comprised of aluminum or an aluminum alloy that has been anodized, treating the oxide layer with a solution containing an anion capable of combining with a cation to form a water-insoluble precipitate, and contacting the treated oxide layer with a second solution containing a cation which combines with the anion to form a water-insoluble precipitate. In certain embodiments, the oxide layer can be treated with a dye to provide a sealed anodized aluminum article exhibiting enhanced dye retention.

18 Claims, 1 Drawing Sheet

PROCESS FOR THE MANUFACTURE OF SEALED ANODIZED ALUMINUM COMPONENTS

CROSS REFERENCE TO RELATED APPLICATION

This application claims the benefit of U.S. Provisional Application Ser. No. 61/390,695, filed on Oct. 7, 2010, entitled SEALED ANODIZED ALUMINUM COMPONENTS AND PROCESS FOR THEIR MANUFACTURE, the entire disclosure of which is hereby incorporated by reference.

FIELD OF THE INVENTION

The invention pertains to sealed anodized aluminum and aluminum alloy components that may or may not be dyed.

BACKGROUND OF THE INVENTION

Anodization is an electrolytic passivation process that increases the thickness of the natural oxide layer on the surface of an aluminum or aluminum alloy component. The process is used to improve resistance to corrosion and wear. Paints, primers, coatings, and adhesives adhere better to anodized aluminum and anodized aluminum alloy surfaces than to untreated surfaces. Another advantage of anodization is that relatively thick porous surfaces can be developed which are capable of absorbing dyes to provide a variety of different colors.

The porous surface developed by anodization creates a vulnerability to corrosion. To reduce this vulnerability to corrosion, a sealing process is often employed. Sealing can also be used to improve dye retention.

In preparation of aluminum or aluminum alloy articles having an anodized surface, the sealing step is often the most time-consuming, energy intensive, and expensive step. In accordance with the various embodiments of the invention, one or a combination of two or more of these issues are addressed.

Currently, there are a large variety of sealing methods commercially employed and described in the patent literature.

The most basic type of sealing involves simply immersing the anodically treated aluminum or aluminum alloy article in water at or near the boiling temperature. The hot water dissolves material from sidewalls of pores in the oxide layer. This material is hydrated to form boehmite, aluminum hydroxide gel, pseudoboehmite, and crystalline boehmite. These various hydrated products then swell and become less water soluble to partially close or seal the pores. This method is inefficient with respect to both time and energy. It typically takes about an hour to properly seal and anodically treated aluminum or aluminum alloy having an oxide film layer thickness of about 0.6 mils, and the energy required to maintain water at or near the boiling temperature is substantial. In addition, material from the oxide layer is destroyed, making the oxide layer softer and less resistant to abrasion.

Other methods of sealing aluminum oxide layers formed by an anodic treatment have been developed. The most popular of these methods involves immersing the anodically treated aluminum article into a solution of hot nickel acetate. The hot water dissolves material from the sidewalls of the pores in the oxide layer, and the dissolved material reacts with nickel ions to form a solid. The time required to seal a 0.6 mil thick oxide layer using this method is about 30 minutes (i.e., about half the time of using hot water at or near the boiling temperature). However, this still represents a very time-consuming and energy intensive process that causes damage to the oxide layer resulting in reduced hardness and reduced abrasion resistance.

SUMMARY OF THE INVENTION

In accordance with certain embodiments of this invention, pores developed in an anodized aluminum or aluminum alloy surfaces are sealed with a precipitate in a more efficient process utilizing less equipment, less energy, and/or less time. As a result, an effective seal can be achieved at a substantially reduced cost. Certain embodiments of the invention can also facilitate higher production rates (i.e., faster conversion of anodized parts into sealed anodized parts) than conventional sealing techniques.

DESCRIPTION OF THE EMBODIMENTS

Figure 1:
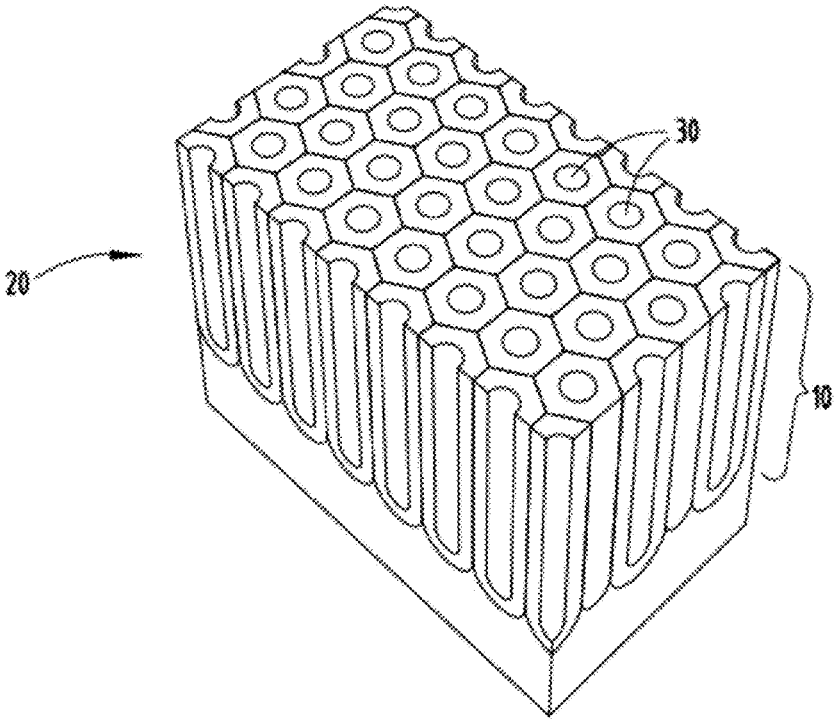
FIG. 1 is a schematic perspective view of the oxide layer formed at the surface of an aluminum or aluminum alloy that has been subjected to an anodizing process.

A process in accordance with certain embodiments of the invention involves providing an article comprised of aluminum or an aluminum alloy that has been anodized (i.e., subjected to a conventional electrolytic passivation process) to augment a natural oxide layer (i.e., increase the thickness) at a surface of the article; treating the oxide layer with a first solution (Step 1) that contains an anion capable of reacting with a cation to form a water-insoluble precipitate; and contacting the treated oxide layer with a second solution (Step 2) containing a cation capable of combining with the anion to form a water-insoluble precipitate. Step 1 "chemically charges" the anodic pores; this material then reacts with Step 2 chemicals to seal the anodic pores. Prior to treatment with the first and second solutions, the anodized article may optionally be treated with a dye to impart color to a surface of the article. The article may be treated in other ways, such as electrolytic coloring.

The term "oxide layer" is used to refer to the aluminum oxide layer at the surface of an aluminum or aluminum alloy article that is naturally present and is made thicker by subjecting the article to an anodizing process.

The term "anodize" and related terms (e.g., anodizing, anodized, etc.) refers to an electrolytic passivation process that augments or increases the thickness of a natural oxide layer on the surface of an aluminum or an aluminum alloy article.

The term "comprised of aluminum" refers to an article that is made of substantially pure aluminum (e.g., greater than 99 percent aluminum by weight), with only minor amounts of impurities, and containing no additives (i.e., elements that are deliberately added to modify properties).

The term "aluminum alloy" refers to an alloy that is predominantly comprised of aluminum, such as from about 90 percent to about 99 percent aluminum by weight, and combined with additional (alloying) elements, such as copper, zinc, manganese, silicon, magnesium, and combinations thereof.

The term "sealing" refers to a process or technique in which the porosity of the oxide layer on an aluminum or aluminum alloy article is reduced, such as by impregnating the pores with a precipitate.

The term "treating the oxide layer with a solution containing an anion capable of reacting with a cation to form a precipitate" refers to immersing the anodized aluminum or aluminum alloy article in a solution containing an anion that is capable of combining with a cation to form a precipitate, spraying such solution at the oxide layer, or otherwise physically contacting the oxide layer with the solution. The anion may or may not react chemically with the anodic coating prior to reacting with the cation.

The term "contacting the treated oxide layer with a second solution that contains a cation capable of combining with the anion to form a water-insoluble precipitate" refers to spraying, dipping, immersing, or otherwise bringing the treated oxide layer into physical contact with a solution that contains a cation that can combine with the anion to form a precipitate (i.e., a water-insoluble solid material). Thus, the term "contacting" as used herein also refers to adding a cation to the first solution to cause a precipitate to form in the pores of the oxide layer.

Type I anodizing refers to chromic acid anodizing, a well-known process often referred to as the Bengough-Stewart process. This process typically produces oxide layers that are relatively thin, in the range from about 0.5 μm to about 18 μm (about 0.02 mils to about 0.7 mils). The films produced by chromic acid anodizing (Type I) are more opaque, softer, more ductile, and self-healing than the oxide layers produced by sulfuric acid anodizing.

Type II anodizing refers to a sulfuric acid anodizing process that produces coatings having a thickness in the range from about 1.8 μm to about 25 μm (about 0.07 mils to about 1 mil).

Type III anodizing, also known as hardcoat, refers to a sulfuric acid anodizing process in which the resulting oxide layers have a thickness greater than 25 μm (1 mil).

Other anodizing techniques include Type IIB, which produces very thin oxide layers using a sulfuric acid anodizing process, organic acid anodizing, phosphoric acid anodizing, borate and tartrate baths, and plasma-electrolytic oxidation.

The invention may be employed to seal an oxide layer on generally any anodized aluminum or aluminum alloy article, irrespective of the anodizing technique employed. However, it is believed that embodiments of the invention will be commercially used most frequently to seal aluminum and aluminum alloy articles that have been subjected to a Type II and other sulfuric acid anodizing techniques.

The dyes that may be optionally employed to impart color to the article are well-known and commercially available. Conventional techniques may be employed for absorbing such dyes into the pores of the oxide layer prior to sealing.

The term "precipitate" refers to a solid phase that is separated from a solution.

The step of treating the oxide layer with a first solution that contains an anion capable of combining with a cation to form a water-insoluble precipitate can be done relatively quickly and can be done at relatively low temperatures, facilitating rapid production that is energy efficient. The objective of this step is to absorb a sufficient quantity of anion into the pores of the oxide layer to facilitate subsequent precipitation with a cation that seals the pores while reducing damage to the anodic coating, thereby reducing porosity, increasing corrosion resistance, and/or enhancing dye retention without adversely affecting hardness, thickness, or integrity of the oxide layer. Achieving an adequate level of anion absorption into the pores of the oxide layer involves balancing various factors, such as the duration of the treatment, the concentration of the anion in the first solution, and the temperature at which the first solution is maintained. Generally, increasing any of the treatment duration, anion concentration, or temperature of the first solution during treatment will tend to increase the amount of anions that are absorbed into the pores of the oxide layer. Because absorption of the anion into the pores of the oxide layer during this treatment step occurs rapidly, and is only weakly dependent on temperature, it is generally unnecessary to expend energy on heating the first solution containing the anion. However, elevated temperatures may be employed if desired, such as a temperature less than 212° F. (about 100° C.), less than 200° F. (about 93° C.), less than 150° F. (above 66° C.), or less than 100° F. (about 39° C.). In order to minimize energy expenses, the treatment with the first solution containing an anion can be conducted at ambient or room temperature, such as about 70° F. (about 21° C.), or less than room temperature. The degree to which step 1 chemistry dissolves the sidewalls of the anodic coating could also affect seal quality (similar to the effects of heat in HOT WATER SEALING and MID TEMPERATURE SEALING).

Figure 2:
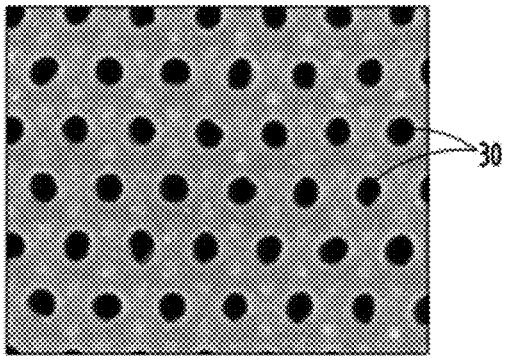
FIG. 2 is a micrograph of the surface of the oxide layer formed on an aluminum article that has been subjected to an anodizing process, as viewed along a direction perpendicular to the surface of the article, the pore openings being clearly visible.
Figure 3:
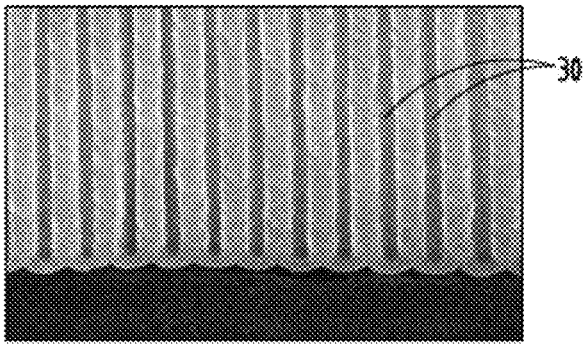
FIG. 3 is a micrograph showing a cross section of the oxide layer shown in FIG. 2.

Shown in FIG. 1 is a schematic perspective view of the oxide layer 10 formed at the surface of an aluminum metal article 20. The oxide layer is characterized by a pattern of parallel pores 30, also shown in the micrographs of FIGS. 2 and 3.

The amount of time needed to achieve a suitable level of absorption of the anion into the pores of the oxide layer depends on several factors, including the anion that is selected, the concentration of the selected anion, the thickness of the oxide layer, and the temperature of the solution. The duration of the treatment with the first solution may be for a period of time that is sufficiently short to avoid substantial attack of the oxide layer as characterized by less than a 20 percent reduction in abrasion resistance determined in accordance with method 6192.1 of FED-STD-141 using CS-17 wheels with 1,000 gram load revolving at 70 revolutions per minute, such as for a period of less than 5 minutes, less than 3 minutes, less than 1 minute, less than 30 seconds, or less than 15 seconds for a typical oxide layer found in Type II anodization. Taking oxide layer thickness into consideration, and depending on the other factors, a period of time that is sufficiently short to avoid substantial attack of the oxide layer is, for example, less than 60 seconds per micrometer, less than 10 seconds per micrometer, less than 5 seconds per micrometer, less than 2 seconds per micrometer, less than 1 second per micrometer, less than 0.5 second per micrometer, or less than 0.1 second per micrometer.

In addition to excessive treatment possibly causing a reduction of the abrasion resistance, excessive treatment can also cause loss of dye during treatment, resulting in a finish product having an undesirably faded color.

The duration of the treatment with the first solution containing an anion should be sufficient to achieve a maximum acid dissolution test rating of 6.0 when tested in accordance with ASTM B680, such as at least 5 seconds, at least 10 seconds, at least 20 seconds, at least 30 seconds, at least 60 seconds, at least two minutes, or up to five minutes.

While a suitable concentration of the anion in the first solution is dependent upon a number of factors, including the chemical and physical properties of the selected anion, a suitable concentration of anion that appropriately minimizes the attack of the oxide layer while achieving adequate sealing quality as characterized by a maximum acid dissolution test rating of 6.0 when tested in accordance with ASTM B680 can, for example, be from about 0.005 to about 0.25 mols per liter, from about 0.010 to about 0.15 mols per liter, or from about 0.020 to about 0.05 mols per liter.

Based on well understood solubility rules, the order in which solutions are added to each other is optional (Example: first solution AgNO3 reacts with second solution NaCl to form AgCl or first solution NaCl reacts with second solution AgNO3 to form AgCl). Our claim involves a two step process which forms an insoluble precipitate inside anodic pores, to seal anodic pores. It may or may not be desirable first fill the oxide layer with a cation capable of combining with an anion to form a water insoluble precipitate.

General Solubility Rules

1. All common compounds of Group I and ammonium ions are soluble.
2. All nitrates, acetates, and chlorates are soluble.
3. All binary compounds of the halogens (other than F) with metals are soluble, except those of Ag, Hg(I), and Pb. Pb halides are soluble in hot water.)
4. All sulfates are soluble, except those of barium, strontium, calcium, lead, silver, and mercury (I). The latter three are slightly soluble.
5. Except for rule 1, carbonates, hydroxides, oxides, silicates, and phosphates are insoluble.
6. Sulfides are insoluble except for calcium, barium, strontium, magnesium, sodium, potassium, and ammonium.

The "General Solubility Rules" listed above are well known and easily available. While we have attempted to list all chemicals which will combine in the anodic pores to form a water insoluble precipitate; our claim involves the reaction of any two chemicals (inside the pores) which will form a water insoluble precipitate to seal the anodic coating.

Examples of water-soluble salts that can be used to introduce and anion into a first solution that can be combined with a cation to form a precipitate include ammonium and alkali metal salts having chloride ($Cl^-$), bromide ($Br^-$) iodide ($I^-$), sulphate ($SO_4^{2-}$), sulfide ($S^{2-}$), hydroxide ($OH^-$), phosphate ($PO_4^{3-}$), carbonate ($CO_3^{2-}$), and sulfite ($SO_3^{2-}$) anions, various other water-soluble sulfates such as magnesium sulfate and copper sulfate, various other water-soluble sulfides, such as magnesium sulfide, and various other water-soluble hydroxides, such as barium hydroxide, strontium hydroxide, radium hydroxide, and thallium hydroxide.

The second solution containing a cation capable of combining with the anion to form a water-soluble precipitate may be prepared by selecting a water-soluble salt having a cation that is capable of combining with the selected anion in the first solution to form a water-insoluble salt or precipitate. Examples of water-insoluble metal salts or precipitates include, nickel hydroxide, silver chloride, silver bromide, silver iodide, lead chloride, lead bromide, lead iodide, mercury chloride, copper chloride, mercury bromide, copper bromide, mercury iodide, copper iodide, thallium chloride, thallium bromide, thallium iodide, silver sulfate, lead sulfate, barium sulfate, strontium sulfate, calcium sulfate, radium sulfate, zinc sulfide, silver hydroxide, magnesium carbonate, copper carbonate, sirium carbonate, barium carbonate, manganese carbonate, iron carbonate, cobalt carbonate, nickel carbonate, silver carbonate, zinc carbonate, cadmium carbonate, aluminum carbonate, telurium carbonate, lead carbonate, lanthanum carbonate, magnesium phosphate, copper phosphate, sirium phosphate, barium phosphate, manganese phosphate, iron phosphate, cobalt phosphate, nickel phosphate, silver phosphate, zinc phosphate, cadmium phosphate, aluminum phosphate, telurium phosphate, lead phosphate, lanthamum phosphate, magnesium sulfite, copper sulfite, sirium phosphite, barium phosphite, manganese phosphite, iron phosphite, cobalt phosphite, nickel phosphite, silver phosphite, zinc phosphite, cadmium phosphite, aluminum phosphite, telurium phosphite, lead phosphite, and lanthanum phosphite.

It will be appreciated by those skilled in the relevant fields of technology that various combinations of water-soluble salts may be employed in the first solution containing an anion capable of combining with a metal cation to form a water-insoluble precipitate, and in the second solution containing the cation that combines with the anion to form the water-insoluble precipitate. For example, the first solution may be prepared by adding an alkali metal (Group IA) hydroxide, such as sodium hydroxide, to water, and the second solution may be prepared by adding a soluble salt of nickel, such as nickel acetate, to water. In this particular example, treatment of the oxide layer with the first solution results in impregnation of the pores of the oxide layer with hydroxide ions. Upon subsequent contact with a second solution containing nickel ion and acetate ion (i.e., a nickel acetate solution), the nickel ions infiltrate the pores and combine with the hydroxyl ions in the pores to form nickel hydroxide, which is a water-insoluble solid or precipitate that closes or seals at least some of the pores, i.e., reduces porosity of the oxide layer. It is also possible to utilize the entire chemical package (i.e., nickel acetate solution). The nickel ions react with hydroxide ions to form nickel hydroxide. At the same time the acetate ion can react with any aluminum ions present in the anodic pores to form aluminum acetate (some salts of aluminum acetate are insoluble).

This sealing effect has several important benefits. Most importantly, it substantially enhances corrosion resistance and improves dye retention when the dye is absorbed into the pores of the oxide layer prior to treatment with the above-referenced solutions.

Various embodiments take advantage of the fact that nickel oxides, hydroxides, sulfides, arcenide, chromate, carbonate, phosphate, and selenide, are water-insoluble nickel compounds. Chemicals such as ammonia, which increase the concentration of hydroxide ion in solution, will also work. In the case of nickel acetate sealing, one of the reactions that takes place is $Ni^{+2}+2OH^- \Longrightarrow Ni(OH)_2$ (a solid). The nickel hydroxide forms a solid which at least partially fills at least some of the pores and seals the oxide layer without damaging the oxide layer (i.e., without reducing the abrasion resistance of the oxide layer).

As a specific example, the invention in accordance with certain aspects thereof, may be practiced by filling or at least partially filling a tank or container with a solution of sodium hydroxide, immersing the anodized aluminum or aluminum alloy article in the sodium hydroxide solution, under conditions sufficient to allow the sodium hydroxide to enter the pores of the metal oxide layer, removing the anodized aluminum or aluminum alloy article from the sodium hydroxide solution after an adequate amount of hydroxide anions have entered the pores of the metal oxide layer, immersing the treated articles having hydroxyl ions in the pores of the oxide layer in a nickel acetate seal solution for a time sufficient to precipitate nickel hydroxide in the pores and thereby seal the pores. The efficiency of this process can be enhanced with the installation of adequate filter systems on the final rinse as well as the sodium hydroxide and nickel acetate tanks. Also, a spray rinse, temperature controls, and automatic chemical addition systems will improve the effectiveness of the process. The addition of surfactants, such as Triton ® x-100, to the solutions may be beneficial.

Some of the benefits that may be achieved in accordance with certain embodiments of the invention include superior line efficiency (e.g., most operations will be able to run as many as three times as many parts in any given time period as compared with known sealing processes), improved quality of anodic coating (the destruction of materials from the metal oxide layer to form the seal substance in conventional processes is greatly reduced or eliminated, thereby achieving a sealed metal oxide layer that is harder and more scratch resistant), improved seal quality (e.g., because the process can be achieved in a fraction of the time needed for conventional sealing techniques, thereby reducing the temptation to reduce prescribed seal times needed to produce a superior product), and requires only minor changes to existing seal systems.

The step of contacting the treated oxide layer with a second solution containing a cation capable of combining with the anion to form a water-insoluble precipitate may (or may not) employ conventional, commercially available seal solutions, such as nickel acetate sealing solutions (e.g., Anoseal® 2000 from Henkel). The time needed to effect precipitation of insoluble metal salts in the pores of the metal oxide layer is typically on the order of minutes, such as less than 10 minutes, less than 8 minutes, less than 6 minutes, less than 5 minutes, less than 4 minutes, or less than 3 minutes. Because the water-solubility of many nickel salts varies little with temperature, the temperature of the nickel acetate seal or other second solution or seal solution containing a cation capable of combining with the anion to form a water-insoluble precipitate can be much less than 200° F., such as less than 190° F., less than 180° F., less than 150° F., less than 125° F., less than 100° F., or less than 70° F.

Table 1 lists the results of tests on aluminum coupons that were subjected to Type II anodizing technique. Each coupon was immersed in a commercially available nickel acetate sealing solution for a period of 10 minutes at 190° F. after being subjected to a conventional black dye treatment. The coupons in Examples 2 and 4 were treated with a sodium hydroxide solution at ambient or room temperature (about 70° F.) for a period of 30 seconds after the dye treatment, but before the nickel acetate seal treatment, whereas Examples 1 and 3 were not treated with a solution containing an anion capable of combining with a cation to form a water-insoluble precipitate. The sodium hydroxide concentrations used for the treatments in Examples 2 and 4 were 1.00 grams per liter and 1.99 grams per liter, respectively. Examples 5-8 and 9-12 are analogous to the series of Examples 1-4, with the differences in the treatment times, oxide layer thickness, anion treatments, and concentrations set forth in Table 1. The results show that treatment with the first solution containing an anion that will combine with the cation in the second (sealing) solution greatly improves (reduces) the ADT rating. Extremely high acid dissolution test ratings, characteristic of extremely poor seal quality, result in the absence of treating the oxide layer with a first solution that contains an anion capable of combining with a cation to form a water-insoluble precipitate. The results also indicate that a balance of good seal quality and dye retention (determined by a visual inspection) is achieved by immersing the anodized aluminum article in the first solution containing the anion capable of combining with a cation to form a water-insoluble precipitate for a period of about 15 seconds when the oxide layer has a thickness of about 0.8 mils.

TABLE 1

| Example | STEP 1 Treatment Time (seconds) | Sample ID | Comments | Coating Thickness (Mils) | ADT Rating 6.0 Max | Concentration of Treatment Chemical (g/l) | Step 1 Treatment Chemical Used | Dye retention (visually determined) | Remarks |
|---|---|---|---|---|---|---|---|---|---|
| 1 | 0 | A | 10 min seal, untreated | 0.93 | 156.2 | none | none | | This group shows the effect of different step 1 treatment times along with different concentrations of chemicals on dyed parts |
| 2 | 30 | A | 10 min seal, treated | 0.93 | 9.9 | 1.00 | NaOH | noticable dye loss | |
| 3 | 0 | A | 10 min seal, untreated | 0.95 | 162.2 | none | none | | |
| 4 | 30 | A | 10 min seal, treated | 0.95 | 38.9 | 1.99 | NaOH | serious dye loss | |
| 5 | 0 | B | 10 min seal, untreated | 0.89 | 85.9 | none | none | | |
| 6 | 10 | B | 10 min seal, treated | 0.89 | 52.2 | 1.00 | NaOH | good dye retention | but poor ADT results |
| 7 | 0 | B | 10 min seal, untreated | 0.88 | 71.1 | none | none | | |
| 8 | 10 | B | 10 min seal, treated | 0.88 | 33.8 | 1.99 | NaOH | good dye retention | but poor ADT results |
| 9 | 0 | C | 10 min seal, untreated | 0.78 | 81.4 | none | none | | |
| 10 | 15 | C | 10 min seal, treated | 0.78 | 6.3 | 2.24 | KOH | good dye retention | and good ADT results |
| 11 | 0 | C | 10 min seal, untreated | 0.80 | 86.1 | none | none | | |
| 12 | 15 | C | 10 min seal, treated | 0.80 | 6.1 | 1.60 | NaOH | good dye retention | and good ADT results |

Table 2 lists further examples in which samples were subjected to Type II anodization and thereafter some were also treated with conventional dye. Other samples were not dyed. Examples 13, 15, 17, 19, 21, 23, 25, 27, 29 and 31 were not subjected to treatment with a solution containing an anion (step 1) capable of combining with a cation in the seal solution (step 2). Examples 14, 16, 18, 20, 22, 24, 26, 28, 30, and 32 were treated with a solution (step 1) in which hydroxyl or other appropriate anions or mixture of anions, for various times listed in table 2 (under "STEP 1"). The seal (Step 2) step was done with commercially available nickel acetate solution for times which ranged from 8 to 12 minutes at approximately 190 degrees F. The results indicate that satisfactory seal quality, as determined by ADT results, cannot be achieved in the 8 to 12 minute time period without step 1 treatment (even with anodic coating as thin as 0.3 mil). The results also show that generally acceptable seal quality can be achieved using step 1 in combination with a solution of commercially available nickel acetate solution. In addition the results show that a combination of good dye retention and seal quality (ADT result) can be achieved for a given oxide layer thickness by appropriate adjustment step 1 treatment time (Examples 13-18), as well as the particular anion or anion concentration (example 19-20) used. The relatively narrow (but easily achievable) window of opportunity concerning dyed anodic coating and step 1 treatment time is also demonstrated. Examples 25-28 illustrate the mild effect of heating the step 1 solution from room temperature to 100 degrees F. Whereas (Examples 29-32) portray the effects of step 1 seal time, coating thickness, step 2 treatment time and step 1 choice of chemical with seal quality.

employed for generating the anions in the first solution (e.g., $NH_4OH$ and NaOH); that thinner coatings (e.g., less than 0.5 mils) can be adequately sealed in less than 5 minutes (combined treatment time for both the anion solution or STEP 1 treatment and the seal solution treatment), and that higher metal in concentrations (e.g., nickel ion) in the seal solution can increase seal quality (ADT result). This increase in seal quality using different concentrations of nickel acetate is not possible without Step 1 treatment. This occurs because dissolution of materials from the sidewalls of the anodic pores is not the rate determining step of the sealing process.

TABLE 2

| Example | Step 1 Treatment Time (sec) | Sample ID | Comments | Coating Thickness (Mils) | ADT Rating 6.0 Max | Concentration of Treatment Chemical (g/l) | Step 1 Treatment Chemical Used | Dye retention (Visually determined) | Remarks |
|---|---|---|---|---|---|---|---|---|---|
| 13 | 0 | 1A | 10 seal untreated | 0.7 | 101.4 | none | | | |
| 14 | 15 | 1A | 10 seal, treated | 0.7 | 39.6 | 1.4 | KOH | good dye retention | |
| 15 | 0 | 1A | 12 seal, untreated | 0.6 | 44.7 | none | | | |
| 16 | 30 | 1A | 12 seal treated | 0.6 | 6.4 | 1.4 | KOH | poor dye retention | |
| 17 | 0 | 1A | 12 seal, untreated | 0.6 | 36.6 | none | | | |
| 18 | 45 | 1A | 12 seal treated | 0.6 | 4.4 | 1.0 | NaOH | poor dye retention | |
| 19 | 0 | 1A | 10 seal untreated | 0.5 | 83.5 | none | | | |
| 20 | 30 | 1A | 10 seal treated | 0.5 | 6.5 | 2.0 | NH4OH | good dye retention with NH4OH | |
| 21 | 0 | 1A | 8 min seal untreated | 1.0 | 178.5 | none | | | |
| 22 | 60 | 1A | 8 min seal treated | 1.0 | 7.2 | 3.0 | KOH/NH4OH | longer step 1 with 8 min seal dye retention not considered | |
| 23 | 0 | 1A | 8 min seal untreated | 0.7 | 113.7 | none | | | |
| 24 | 60 | 1A | 8 min seal treated | 0.7 | 3.1 | 3.0 | KOH/NH4OH | longer step 1 with 8 min seal dye retention not considered | |
| 25 | 0 | 1B | no step1, 10 min seal | 0.9 | 166.9 | none | | | The 1B group shows the effect of step 1 at room temperature or step 1 at 100 F. |
| 26 | 30 | 1B | cold step1, 10 min seal | 0.9 | 28.0 | 0.33 | CA(OH)2 | slight ADT difference | |
| 27 | 0 | 1B | no step1, 10 min seal | 0.9 | 168.0 | none | | | |
| 28 | 30 | 1B | 100 F step1, 10 min seal | 0.9 | 16.9 | 0.33 | CA(OH)2 | going from room temp to 100 F. (step 1) | |
| 29 | 0 | 1C | 8 min seal, untreated | 0.7 | 113.7 | none | | | |
| 30 | 60 | 1C | 8 min seal, treated | 0.7 | 3.1 | 4.0 | NH4OH | longer step 1 time can reduce step 2 time | |
| 31 | 0 | 1D | 8 min seal, untreated | 0.3 | 32.5 | none | | | |
| 32 | 60 | 1D | 8 min seal, treated | 0.3 | 6.7 | 4.4 | NH4OH/NaOH | thin coating use of a mixture | |

Table 3 lists additional test results (Examples 33-46) showing that a combination of two different sources may be

TABLE 3

| Example | STEP 1 Treatment Time (seconds) | Sample ID | Comments | Coating Thickness (Mils) | ADT Rating 6.0 Max | Concentration of Treatment Chemical (g/l) | Treatment Chemical Used | | Remarks |
|---|---|---|---|---|---|---|---|---|---|
| 33 | 15 | 1E | 8 min seal, treated | 0.70 | 0.1 | 4.6 | NH4OH/NaOH | use a mixture | |
| 34 | 0 | 1E | 8 min seal, untreated | 0.70 | 127.7 | | | of 2 chemicals | |
| 35 | 15 | 1F | 4 min seal, treated | 0.44 | 11.0 | 0.33 | CA(OH)2 | shows effect of treatment time | |
| 36 | 0 | 1F | 4 min seal, untreated | 0.44 | 37.7 | | none | also shows that less total seal time is ok with | |
| 37 | 30 | 1F | 4 min seal, treated | 0.39 | 4.4 | 0.33 | CA(OH)2 | less thick coating | |
| 38 | 0 | 1F | 4 min seal, untreated | 0.39 | 28.2 | | none | | |
| 39 | 15 | 1G | 10 seal, treated | 0.87 | 5.8 | 2.14 | NaOH | 5.7 g/l nickel acetate | different nickel concentrations (step 2) can also effect the seal quality |
| 40 | 0 | 1G | 10 seal, untreated | 0.87 | 97.5 | | none | 5.7 g/l nickel acetate | |
| 41 | 15 | 1G | 10 seal, treated | 0.79 | 5.6 | 2.14 | NaOH | 5.7 g/l nickel acetate | |
| 42 | 0 | 1G | 10 seal, untreated | 0.79 | 91.0 | | none | 5.7 g/l nickel acetate | |
| 43 | 15 | 1G | 10 seal, treated | 0.92 | 2.6 | 2.14 | NaOH | 13.9 g/l nickel acetate | |
| 44 | 0 | 1G | 10 seal, untreated | 0.92 | 169.2 | | none | 13.9 g/l nickel acetate | |
| 45 | 15 | 1G | 10 seal, treated | 0.85 | 1.8 | 2.14 | NaOH | 13.9 g/l nickel acetate | |
| 46 | 0 | 1G | 10 seal, untreated | 0.85 | 158.1 | | none | 13.9 g/l nickel acetate | |

Table 4 shows the effect of low temperature sealing. With a currently used "MID TEMP SEAL", virtually no sealing occurs at a temperature below 160F. The large difference in ADT rating between the treated and untreated coating at 130F demonstrates the ability of this idea to save energy as well as time.

TABLE 4

| Example | STEP 1 Treatment Time (seconds) | Sample ID | Comments | Coating Thickness (Mils) | ADT Rating 6.0 Max | Concentration of Treatment Chemical (g/l) | Treatment Chemical Used |
|---|---|---|---|---|---|---|---|
| 47 | 60 | 1H | 130 F. seal 60 sec treat | 0.67 | 4.2 | 1.0 | Ca(OH)2 |
| 48 | 0 | 1H | 130 F. seal untreated | 0.67 | 117.9 | 0.0 | none |

The idea involved in this invention is novel in a number of ways:

First of all, the time required to seal anodized material is greatly shortened; anodized material of 0.6 mil thickness (1 mil=1/1000 of an inch) can be sealed in 10 minutes. Coating of this thickness takes approximately 30 minutes to seal using the present "hot nickel acetate" method. The "hot nickel acetate" system is only one out of many sealing techniques, but is currently industry's most favored means of sealing anodic coating. Thinner coatings can be sealed in as little as 1 minute.

Also the material used to form the "insoluble precipitate" is not wholly from the anodic coating. This means that it is less necessary to degrade the coating in order to seal the pores. Because of this, the hardness and scratch resistance of the anodic coating is less compromised. The method can be used to seal any type of anodic coating which contains pores (with reduced damage to the coating).

The method is very simple (only 2 required steps); and could be implemented on virtually any anodizing line without the addition of extra tanks (by simply changing the final rinse tank before sealing to a "step 1 tank"). The method does not require additional expensive treatment tanks and rinse tanks.

Both the environmental and economic costs of energy usage are greatly reduced. Currently, the "hot nickel acetate" method requires that "seal tank" temperatures be maintained between 180 and 200 degrees F. (Fahrenheit). The financial cost of maintaining large open air tanks at these temperatures is considerable. Since the solubility of most of the "insoluble precipitates" (one of many examples is nickel hydroxide) are only slightly affected by temperature; these "energy costs" can be greatly reduced. Of course, the reduction of energy usage also reduces the need to burn fossil fuels and is environmentally friendly.

Nickel acetate is one of many possible "step two" chemicals, but the temperature of the nickel acetate can be greatly reduced. Also unlike the current "hot nickel acetate" method (sometimes known as mid-temperature), the concentration of nickel acetate (or any other step 2 chemical) can be increased to reduce seal time. Currently the rate determining seal step requires high temperatures to dissolve the anodic coating from the sidewalls of the coating. Since this method is less dependent on dissolved anodic coating; the concentration of step 2 chemicals can be altered to achieve the required seal time and quality.

Worker safety is enhanced. Every year many people are burned (some have been killed) because they are forced to work with hot solutions. Reducing the need for high temperature solutions in the workplace will improve worker safety.

Using the pores in anodic coating to change the color (using an assortment of possible dyes) of the oxide layer is a very important part of the anodizing industry. The methods disclosed herein provide gentle conditions concerning "step 1", in terms of temperature, duration of treatment, concentration of chemicals and choice of chemicals used. This allows dyed anodic coating to be quickly sealed without deleteriously affecting color. This approach is truly original and innovative. Also the gentle conditions described here reduce damage to the coating itself. Treating the coating for long periods of time, with high temperatures in step 1(such as boiling NaOH solutions), can in addition to reducing dye retention, damage the anodic coating itself. The proof of this statement involves the fact that industry sometimes uses such conditions in carwashes (high pH, high temperature and high chemical concentration) to rate seal quality. In unsealed coating, these conditions can dissolve material from the sidewalls of the pores and weaken the coating.

What is claimed is:

1. A process of sealing an anodized aluminum article, comprising:

providing an article comprised of aluminum or an aluminum alloy that has been anodized to increase a thickness of a natural oxide layer at a surface of the article;

optionally treating the oxide layer with a dye to impart color to the surface of the article;

treating the oxide layer with a first solution containing an anion capable of combining with a cation to form a water-insoluble precipitate, such that the duration of contact between the oxide layer and the first solution is less than 5 minutes; and contacting the treated oxide layer with a second solution containing a cation that combines with the anion to form a water-insoluble precipitate.

2. The process of claim 1, in which treatment with the first solution is done for a period of time that is sufficiently short to avoid substantial attack of the oxide layer as characterized by less than a 20 percent reduction in abrasion resistance determined in accordance with method 6192.1 of FED-STD-141 using CS-17 wheels with 1,000 gram load revolving at 70 revolutions per minute.

3. The process of claim 1, in which the treatment with the first solution is done for a period of time that is less than 3 minutes.

4. The process of claim 1, in which the treatment with the first solution is done for a period of time that is less than 1 minute.

5. The process of claim 1, in which the treatment with the first solution is done for a period of time that is less than 30 seconds.

6. The process of claim 1, in which the treatment with the first solution is of sufficiently long duration to achieve a maximum acid dissolution test rating of 6.0 when tested in accordance with ASTM B680.

7. The process of claim 1, in which the treatment with the first solution is for a period of at least 5 seconds.

8. The process of claim 1, in which the treatment with the first solution is for a period of at least 10 seconds.

9. The process of claim 1, in which the treatment with the first solution is for a period of at least 20 seconds.

10. The process of claim 1, in which the treatment with the first solution is for a period of at least 30 seconds.

11. The process of claim 1, in which the treatment with the first solution is for a period of at least 60 seconds.

12. The process of claim 1, wherein the oxide layer is treated with a dye to impart color to the surface of the article before treating the oxide layer with the first solution containing an anion.

13. The process of claim 1, wherein the cation in the second solution is selected from silver, lead, copper, barium, strontium, copper, manganese, iron, cobalt, nickel, zinc, cadmium, aluminum, thallium, and lorensium, provided that the resulting precipitate formed by combining the anion with the metal cation is selected from nickel hydroxide, silver chloride, silver bromide, silver iodide, lead chloride, lead bromide, lead iodide, mercury chloride, copper chloride, mercury bromide, copper bromide, mercury iodide, copper iodide, thallium chloride, thallium bromide, thallium iodide, silver sulfate, lead sulfate, barium sulfate, strontium sulfate, calcium sulfate, radium sulfate, zinc sulfide, silver hydroxide, magnesium carbonate, copper carbonate, sirium carbonate, barium carbonate, manganese carbonate, iron carbonate, cobalt carbonate, nickel carbonate, silver carbonate, zinc carbonate, cadmium carbonate, aluminum carbonate, tellurium carbonate, lead carbonate, lanthanum carbonate, magnesium phosphate, copper phosphate, sirium phosphate, barium phosphate, manganese phosphate, iron phosphate, cobalt phosphate, nickel phosphate, silver phosphate, zinc phosphate, cadmium phosphate, aluminum phosphate, telurium phosphate, lead phosphate, lanthamum phosphate, magnesium sulfite, copper sulfite, sirium phosphite, barium phosphite, manganese phosphite, iron phosphite, cobalt phosphite, nickel phosphite, silver phosphite, zinc phosphite, cadmium phosphite, aluminum phosphite, tellurium phosphite, lead phosphite, and lanthanum phosphite.

14. The process of claim 1, wherein the anion in the first solution is selected from chloride, bromide, iodide, sulfate, sulfide, hydroxide, phosphate, carbonate and sulfite.

15. The process of claim 1, in which the concentration of chemicals in the first solution is between 0 g/l and 500 g/l.

16. The process of claim 1, in which the temperature of the first solution is between 0° F. and 212° F. during the treatment.

17. The process of claim 1, in which the concentration of the chemicals in the second solution is between 0 g/l and 500 g/l.

18. The process of claim 1, in which the temperature of the second solution is between 0° F. and 212° F. during the treatment.

* * * * *